United States Patent [19]

Kaminsky

[11] Patent Number: 4,487,710

[45] Date of Patent: Dec. 11, 1984

[54] GRANULAR DETERGENTS CONTAINING ANIONIC SURFACTANT AND ETHOXYLATED SURFACTANT SOLUBILITY AID

[75] Inventor: George J. Kaminsky, Cincinnati, Ohio

[73] Assignee: The Procter & Gamble Company, Cincinnati, Ohio

[21] Appl. No.: 353,756

[22] Filed: Mar. 1, 1982

[51] Int. Cl.[3] ..... C11D 1/18

[52] U.S. Cl. ..... 252/546; 252/531; 252/532; 252/534; 252/539; 252/550; 252/551; 252/553; 252/558

[58] Field of Search ..... 252/527, 531, 532, 535, 252/539, 540, 546, 550, 551, 554, 558, 559; 264/117

[56] References Cited

U.S. PATENT DOCUMENTS

| | | | |
|---|---|---|---|
| 3,140,261 | 7/1964 | Noad . | |
| 3,144,412 | 8/1964 | Inamorato . | |
| 3,231,504 | 1/1966 | Marion et al. . | |
| 3,355,390 | 11/1967 | Behrens . | |
| 3,634,266 | 1/1972 | Theile . | |
| 3,793,233 | 2/1974 | Rose et al. . | |
| 3,814,692 | 6/1974 | Mostow . | |
| 3,928,249 | 12/1975 | Nunziata et al. . | |
| 3,963,649 | 6/1976 | Spadini et al. . | |
| 4,029,608 | 7/1977 | Murata et al. | 252/551 |
| 4,102,823 | 7/1978 | Matheson et al. | 252/533 |
| 4,144,201 | 3/1979 | Winterbotham et al. . | |
| 4,259,215 | 3/1981 | Murata et al. | 252/528 |
| 4,297,251 | 10/1981 | Bernardino | 252/545 |
| 4,316,824 | 2/1982 | Pancheri | 252/551 |

FOREIGN PATENT DOCUMENTS

| | | |
|---|---|---|
| 1118908 | 7/1968 | United Kingdom . |
| 1341557 | 12/1978 | United Kingdom . |

*Primary Examiner*—John E. Kittle
*Assistant Examiner*—José G. Dees
*Attorney, Agent, or Firm*—Donald E. Hasse; Robert B. Aylor; Edmund F. Gebhardt

[57] ABSTRACT

Granular detergent compositions containing an anionic surfactant, an ethoxylated surfactant solubility aid and a water-soluble neutral or alkaline salt are disclosed. The compositions are prepared by forming an intimate mixture of the anionic and ethoxylated surfactants and then agglomerating the mixture with the neutral or alkaline salt.

5 Claims, No Drawings

GRANULAR DETERGENTS CONTAINING ANIONIC SURFACTANT AND ETHOXYLATED SURFACTANT SOLUBILITY AID

TECHNICAL FIELD

The present invention relates to granular detergent compositions containing an anionic surfactant, an ethoxylated surfactant and a water-soluble neutral or alkaline salt. The compositions are prepared by forming an intimate mixture of the anionic and ethoxylated surfactants and then agglomerating the mixture with the neutral or alkaline salt. The ethoxylated surfactant allows the granular detergents herein containing anionic surfactants to dissolve or disperse more rapidly in a laundering solution.

Granular detergents made using conventional spray-drying processes generally have satisfactory solubility, if the individual components are soluble or dispersible in water, due to their substantial porosity. However, spray-dried granules have a relatively low density, typically less than about 0.4 g/ml. Higher density granular detergents, made by various mechanical mixing and agglomeration processes, can provide advantages in terms of reduced packaging, handling and storage costs but are less porous and generally have lower solubility rates. High density detergents containing anionic surfactants often have even lower solubility rates because anionic surfactants tend to form a sticky gel phase when they contact the laundering solution. This can result in noticeable undissolved detergent globs on fabrics.

The primary object of the present invention is to improve the solubility of high density granular detergents containing anionic surfactants. The invention is, however, broadly applicable to any granular detergents made by agglomerating the intimate mixture of anionic and ethoxylated surfactants with a neutral or alkaline salt.

BACKGROUND ART

U.S. Pat. No. 4,029,608, Murata et al, issued June 14, 1977, discloses granular detergents containing anionic or nonionic surfactants having a tendency to cake and condensation products of $C_{12-18}$ alcohols with from 100 to 300 moles of ethylene oxide as anticaking agents. The compositions specifically disclosed are prepared by drying a slurry of the components to produce a powder.

U.S. Pat. No. 3,355,390, Behrens, issued Nov. 28, 1967, discloses granular detergent compositions containing ethoxylated nonionic surfactants, builder salts and, optionally, anionic cosurfactants. The compositions are prepared by spray drying a detergent slurry.

U.S. Pat. No. 3,814,692, Mostow, issued June 4, 1974 discloses free-flowing particulate blends of soap and nonionic surfactants which can be combined with builders or added to spray-dried detergents.

U.S. Pat. No. 3,144,412, Inamorato, issued Aug. 11, 1964 discloses granular detergents containing a homogeneous mixture of alkyl phenol polyethoxylate nonionic surfactants, alkyl aryl sulfonate anionic surfactants and cellulose polyvinyl alcohol soil suspending agents. The compositions are preferably prepared by spray-drying a slurry of the components.

British Pat. No. 1,341,557, Brandt et al, published Dec. 28, 1973, discloses agglomerated detergents made by spraying liquids, including liquid or pasty surfactants, onto builder salts in a fluidized bed.

SUMMARY OF THE INVENTION

The present invention encompasses granular detergent compositions comprising:

(a) from about 5% to about 50% by weight of an anionic surfactant containing from 0% to about 50% by weight of ethylene oxide, or mixtures thereof;

(b) from about 1% to about 50% by weight of the anionic surfactant (a) of an ethoxylated surfactant selected from the group consisting of:

(1) anionic surfactants of the formula $R(OC_2H_4)_nOSO^-{}_3M^+$, wherein R is an aliphatic hydrocarbon group containing from about 10 to about 18 carbon atoms or an alkyl phenyl group in which the alkyl contains from about 8 to about 15 carbon atoms, n is selected such that the surfactant contains from about 50% to about 95% by weight of ethylene oxide, and M is an alkali metal, alkaline earth metal, ammonium or substituted ammonium cation;

(2) nonionic surfactants of the formula $R(OC_2H_4)_nOH$, wherein R is an aliphatic hydrocarbon group containing from about 10 to about 18 carbon atoms or an alkyl phenyl group in which the alkyl contains from about 8 to about 15 carbon atoms and n is selected such that the surfactant contains from about 60% to about 95% by weight of ethylene oxide;

(3) copolymers of ethylene oxide and propylene oxide having an average molecular weight of from about 500 to about 15,000 and containing from about 40% to about 95% by weight of ethylene oxide; and mixtures thereof; and (c) from about 5% to about 90% by weight of a water-soluble neutral or alkaline salt, or mixtures thereof; said composition prepared by forming an intimate mixture of the anionic surfactant (a) and the ethoxylated surfactant (b) and then agglomerating said mixture with the water-soluble neutral or alkaline salt.

DETAILED DESCRIPTION OF THE INVENTION

The granular detergent compositions of the present invention contain an anionic surfactant, an ethoxylated surfactant and a water-soluble neutral or alkaline salt. The compositions are prepared by forming an intimate mixture of the anionic and ethoxylated surfactants and then agglomerating the mixture with the neutral or alkaline salt. As used herein, agglomeration can be accomplished by agitating in the presence of a suitable binder or by mechanically mixing under pressure (e.g., extruding, pressing, milling, compacting or pelletizing). Final sizing of the agglomerates can be achieved by grinding and screening. The agglomerates produced preferably have a density of from about 0.45 to about 0.85 g/ml, more preferably from about 0.55 to about 0.75 g/ml, and exhibit improved solubility due to the intimate mixture of the anionic and ethoxylated surfactants.

The intimate mixture can conveniently be obtained by drying a solution, paste or slurry of the anionic and ethoxylated surfactants or their precursors. Intimate mixtures can also be obtained by dry mixing the surfactants in powdered form followed by a mechanical process such as extrusion or milling to produce particulates. In a preferred embodiment, the precursors of an anionic surfactant (e.g., alkyl benzene, fatty alcohol, paraffin, olefin, etc.) and of an ethoxylated surfactant herein (e.g., ethoxylated alcohol or ethoxylated alkyl phenol) are sulfated/sulfonated, neutralized and dried together to form the intimate mixture. The intimate mixture can also contain minor amounts, less than 50% by weight and generally less than 25% by weight, of a neutral or alkaline salt or of suitable optional ingredients herein. Premixing of some of the salt into the intimate mixture can enhance solubility of poorly dissolving anionic surfactants by dilution and separation of anionic surfactant with a highly soluble salt phase.

Once formed, the intimate mixture is agglomerated with the neutral or alkaline salt to produce complete granular detergents while maintaining the intimate mixture of anionic and ethoxylated surfactants. Agglomeration is preferably accomplished by spraying, using conventional techniques, a sticky paste of the anionic and ethoxylated surfactants onto the salt while agitating the salt in equipment such as a fluidized bed, a tumble mixer, or a rotating drum or pan. The moisture content of the paste can be controlled by adding water or evaporating excess water to provide the desired stickiness for agglomeration. Binders or agglomerating agents known in the art can also be used to aid agglomeration, especially of relatively dry mixes of the intimate mixture and salt.

While not intending to be limited by any particular theory, it is believed that the ethoxylated surfactants herein improve the solubility of the present compositions by modifying the distribution of the anionic surfactant between the surfactant-rich phase (usually called neat sope phase) and the electrolyte-rich phase (usually called lye or nigre phase). The ethoxylated surfactant is thought to reduce the solubility of the anionic surfactant in the lye phase and concentrate it in the sope phase, thereby localizing and minimizing the sticky gel formed when the anionic surfactant contacts the laundering solution. The gel-forming anionic surfactant phase probably becomes discontinuous, with high interfacial area for dissolving, and no longer dominates or controls the rate of dissolving.

Anionic Surfactant

The detergent compositions herein contain from about 5% to about 50% by weight of an anionic surfactant, or mixtures thereof, which can contain up to about 50% by weight of ethylene oxide. The anionic surfactant preferably represents from about 10% to about 30%, and more preferably from about 12% to about 20%, by weight of the detergent composition. Anionic surfactants useful herein are disclosed in U.S. Pat. No. 3,664,961, Norris, issued May 23, 1972, and in U.S. Pat. No. 3,919,678, Laughlin et al., issued Dec. 30, 1975, both incorporated herein by reference.

Useful anionic surfactants include the water-soluble salts, particularly the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 4 units of ethylene oxide per molecule and wherein the alkyl groups contain from about 8 to about 12 carbon atoms; and sodium or potassium salts of alkyl ethylene oxide ether sulfates containing about 1 to about 4 units of ethylene oxide per molecule and wherein the alkyl group contains from about 10 to about 20 carbon atoms.

Other useful anionic surfactants herein include the water-soluble salts of esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 4 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Water-soluble salts of the higher fatty acids, i.e., "soaps", also are useful anionic surfactants herein. Soaps can be made by direct saponification of fats and oils or by the neutralization of free fatty acids. Examples of soaps are the sodium, potassium, ammonium, and alkylolammonium salts of higher fatty acids containing from about 8 to about 24 carbon atoms, and preferably from about 12 to about 18 carbon atoms. Particularly useful are the sodium and potassium salts of the mixtures of fatty acids derived from coconut oil and tallow, i.e., sodium or potassium tallow and coconut soaps.

Particularly preferred anionic surfactants are the alkali metal (especially sodium) salts of $C_{11-13}$ alkylbenzene sulfonates, $C_{14-18}$ alkyl sulfates, $C_{14-18}$ alkyl polyethoxy sulfates containing from about 1 to about 4 moles of ethylene oxide, and mixtures thereof.

Ethoxylated Surfactant

The compositions of the present invention also contain from about 1% to about 50%, preferably from about 3% to about 35%, and more preferably from about 5% to about 25%, by weight of the anionic surfactant of certain ethoxylated anionic or nonionic surfactants.

Useful ethoxylated anionic surfactants herein are of the formula: $R(OC_2H_4)_nOSO_3^-M^+$, wherein R is an aliphatic hydrocarbon group containing from about 10 to about 18 carbon atoms or an alkyl phenyl group in which the alkyl contains from about 8 to about 15 carbon atoms, n is selected such that the surfactant contains from about 50% to about 95% by weight of ethylene oxide, and M is an alkali metal, alkaline earth metal, ammonium or substituted ammonium cation. Preferred surfactants of this class are the alkyl polyethoxylate sulfates wherein R in the above formula is an alkyl group containing from about 10 to about 18 carbon atoms, n is from about 15 to about 100 (preferably from about 20 to about 80), and M is an alkali metal cation. Sodium tallow alkyl polyethoxy sulfates containing from about 25 to about 35 ethylene oxide units per molecule are particularly preferred.

Ethoxylated nonionic surfactants useful herein are of the formula: $R(OC_2H_4)_nOH$, wherein R is an aliphatic hydrocarbon group containing from about 10 to about 18 carbon atoms or an alkyl phenyl group in which the alkyl contains from about 8 to about 15 carbon atoms and n is selected such that the surfactant contains from about 60% to about 95% by weight of ethylene oxide. Preferred are ethoxylated alcohols of the above formula in which R is an alkyl group containing from about 10 to about 18 carbon atoms and n is from about 15 to about 100, particularly from about 20 to about 80. Highly preferred ethoxylated nonionic surfactants herein are those wherein R is a tallow alkyl group and n is from about 25 to about 35.

Other useful ethoxylated nonionic surfactants are the copolymers of ethylene oxide and propylene oxide having a molecular weight of from about 500 to 15,000, preferably from about 1000 to 5000, and containing from about 40% to about 95% by weight of ethylene oxide. Such copolymers can optionally contain hydroxy or amine groups onto which the alkylene oxides can be polymerized. Condensates of ethylene oxide with a hydrophobic base formed by condensing propylene oxide with propylene glycol are preferred copolymers.

Water-Soluble Neutral or Alkaline Salt

The granular detergents of the present invention also contain from about 5% to about 90%, preferably from about 20% to about 85%, and more preferably from about 40% to about 80%, by weight of a water-soluble neutral or alkaline salt. The neutral or alkaline salt has a pH in solution of seven or greater, and can be either organic or inorganic in nature. The salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides and sulfates. The alkali metal, and especially sodium, salts of the above are preferred. Sodium sulfate is typically found in detergent granules and is a preferred salt herein. It is usually formed during the sulfation/sulfonation and neutralization steps in the production of anionic synthetic surfactants.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176; and 3,400,148, incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Salts of nitrilotriacetic acid, such as sodium nitrilotriacetate, are particularly preferred.

Polymeric polycarboxylate builders are set forth in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein are sodium and potassium carboxymethyloxymalonate, carboxymethyloxysuccinate, cis-cyclohexanehexacarboxylate, cis-cyclopentanetetracarboxylate, phloroglucinol trisulfonate, and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution and converted to the corresponding salt.

The neutral or alkaline salt of the present invention is preferably selected from alkali metal polyphosphates, nitrilotriacetates, carbonates, silicates, sulfates, and mixtures thereof.

Optional Components

Other ingredients commonly used in detergent compositions can be included in the compositions of the present invention. These include auxiliary detergent surfactant and builder materials, color speckles, bleaching agents, and bleach activators, suds boosters or suds suppressors, anti-tarnish and anti-corrosion agents, soil suspending agents, soil release agents, dyes, fillers, optical brighteners, germicides, pH adjusting agents, non-builder alkalinity sources, enzymes, enzyme-stabilizing agents and perfumes.

A preferred, although optional, builder herein is a water-insoluble crystalline or amorphous aluminosilicate ion exchange material. Crystalline material useful herein is of the formula $Na_z[(AlO_2)_z.(SiO_2)_y].xH_2O$ wherein z and y are at least about 6, the molar ratio of z to y is from about 1.0 to about 0.5 and x is from about 10 to about 264. Amorhphous hydrated aluminosilicate materials useful herein have the empirical formula $M_z(_zAlO_2.ySiO_2)$ wherein M is sodium, potassium, ammonium or substituted ammonium, z is from about 0.5 to about 2 and y is 1 said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g The aluminosilicate ion exchange materials herein are still further characterized by their calcium ion exchange rate which is at least about 2 grains/gallon/minute/-gram/gallon of aluminosilicate (anhydrous basis), and generally lies within the range of from about 2 to 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g (12 mg $Mg^{++}$/g) and a $Mg^{++}$ exchange rate of at least about 1 grain/gallon/-minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $Na_{12}[AlO_2)_{12}(SiO_2)_{12}].xH_2O$ wherein x is from about 20 to about 30, especially about 27.

The following non-limiting example illustrates the detergent compositions of the present invention.

All percentages, parts, and ratios used herein are by weight unless otherwise specified.

EXAMPLE 1

| Component | Weight % | | | | | |
|---|---|---|---|---|---|---|
| | A | B | C | D | E | F |
| Group A | | | | | | |
| Sodium $C_{11-13}$ alkyl benzene sulfonate | 3.5 | 3.5 | 14.0 | 14.0 | 16.8 | 16.8 |
| Sodium tallow alkyl sulfate | 5.5 | 5.5 | — | — | — | — |
| Sodium $C_{14-15}$ alkyl polyethoxy (2.25) sulfate | 5.5 | 5.5 | 6.0 | 6.0 | — | — |
| Sodium toluene sulfonate | 1.0 | 1.0 | — | — | — | — |
| Tallow alcohol poly-ethoxylate (30) | — | 3.0 | — | — | — | — |
| Sodium tallow alkyl polyethoxy (30) sulfate | — | — | — | 4.0 | — | — |
| EO/PO copolymer* | — | — | — | — | — | 3.0 |
| Group B | | | | | | |
| Sodium tripoly-phosphate | 25.0 | 25.0 | — | — | 33.0 | 33.0 |
| Sodium carbonate | 10.0 | 10.0 | 21.0 | 21.0 | — | — |
| Hydrated sodium Zeolite A (avg. dia. 3 microns) | 20.0 | 20.0 | — | — | — | — |
| Sodium silicate (2.0r) | 2.0 | 2.0 | 20.0 | 20.0 | 5.5 | 5.5 |
| Sodium sulfate | 22.0 | 19.0 | 33.5 | 30.5 | 35.2 | 32.2 |
| Miscellaneous minors | 0.5 | 0.5 | 0.5 | 0.5 | 0.5 | 0.5 |
| Moisture | 5.0 | 5.0 | 5.0 | 5.0 | 8.0 | 8.0 |

*Condensate of ethylene oxide with hydrophobic base formed by condensing propylene oxide with propylene glycol (m. wt. 3000, 60% ethylene oxide).

Granular detergents A, B, C and D were prepared by intimately mixing the Group A components to form a surfactant paste containing about 60% moisture by weight. The paste was then sprayed, using an air-atomizing nozzle, in the form of sticky droplets (particle diameter about 50 microns) onto a dry mix of the Group B components (average particle diameter about 50 microns), while agitating in a batch fluidized bed agglomerator. The agglomerates formed had an average particle diameter of about 400–600 microns and a density of about 0.6 g/ml.

In laundering solutions typical of U.S. wash conditions, and especially in cold water (15° C.), Composition B of the present invention dispersed and dissolved more rapidly than Composition A, which does not contain an ethoxylated surfactant herein. Similar results were obtained when Composition D of the invention was compared with Composition C. When prepared and tested in a similar manner, Composition F of the invention would disperse and dissolve more rapidly than Composition E.

Compositions B, D and F can also be prepared by spraying the paste of the Group A components in the form of relatively dry particles onto the Group B components and separately spraying onto the mixture a 40% by weight sodium silicate (2.0r) solution to aid agglomeration. Granular detergents herein can also be prepared by extruding a mixture of the Group A particles and Group B components, with grinding and screening to achieve the desired agglomerate size range.

Other compositions of the present invention are obtained when the ethoxylated surfactant solubility aids of Compositions B, D, and F are replaced with sodium tallow alkyl polyethoxy sulfates containing 10, 22 or 80 ethylene oxide units; sodium coconut alkyl polyethoxy sulfates containing 6, 15, 30 or 100 ethylene oxide units; sodium nonyl phenol polyethoxy sulfates containing 14 or about 60 ethylene oxide units; $C_{12-13}$ alcohol polyethoxylates containing 8, 12, 30, or 80 ethylene oxide units; tallow alcohol polyethoxylates containing 20 or 100 ethylene oxide units; or with condensates of ethylene oxide with a hydrophobic base formed by condensing propylene oxide with propylene glycol, containing about 50% or 80% by weight of ethylene oxide and having a molecular weight of about 1000, 5000, or 10,000.

What is claimed is:

1. A granular detergent composition comprising:

(a) from about 12% to about 20% by weight of an anionic surfactant containing from 0% to about 50% by weight of ethylene oxide selected from the group consisting of alkali metal salts of $C_{11-13}$ alkylbenzene sulfonates, $C_{14-18}$ alkyl sulfates, $C_{14-18}$ alkyl polyethoxy sulfates containing from about 1 to about 4 moles of ethylene oxide and mixtures thereof;

(b) from about 5% to about 25% by weight of the anionic surfactant (a) of anionic surfactants of the formula $R(OC_2H_4)_nOSO_3^-M^+$ wherein R is an alkyl group containing from about 10 to about 18 carbon atoms, n is from about 15 to about 100 and selected such that the surfactant contains from about 50% to about 95% by weight of ethylene oxide, and M is an alkali metal cation; and (c) from about 5% to about 85% by weight of a water-soluble neutral or alkaline salt, or mixtures thereof; said composition prepared by forming an intimate mixture of the anionic surfactant (a) and ethoxylated surfactant (b), forming a sticky paste of said mixture, and then agglomerating said mixture with the water-soluble neutral or alkaline salt.

2. The composition of claims 5 or 6 wherein n is from about 20 to about 80.

3. The composition of claim 2 wherein R is a tallow alkyl group and n is from about 25 to about 35.

4. The composition of claim 1 comprising from about 40% to about 80% by weight of the water-soluble neutral or alkaline salt.

5. The composition of claim 1 wherein the water-soluble neutral or alkaline salt is selected from the group consisting of alkali metal polyphosphates, nitrilotriacetates, carbonates, silicates, sulfates, and mixtures thereof.

* * * * *

UNITED STATES PATENT AND TRADEMARK OFFICE

CERTIFICATE OF CORRECTION

PATENT NO. : 4,487,710

DATED : Dec. 11, 1984

INVENTOR(S) : GEORGE J. KAMINSKY

It is certified that error appears in the above–identified patent and that said Letters Patent are hereby corrected as shown below:

Column 10, line 16, "The composition of Claims 5 or 6" should be "Composition of Claim 1".

Signed and Sealed this

*Twenty-second* Day of *October 1985*

[SEAL]

*Attest:*

DONALD J. QUIGG

*Attesting Officer*

*Commissioner of Patents and Trademarks—Designate*